US007210558B2

(12) United States Patent
Eaves

(10) Patent No.: US 7,210,558 B2
(45) Date of Patent: May 1, 2007

(54) SCAFFOLD HAVING DETACHABLE LADDER ASSEMBLY

(75) Inventor: John Eaves, Moore, OK (US)

(73) Assignee: Votaw Industries, Ltd., Oklahoma City, OK (US)

( * ) Notice: Subject to any disclaimer, the term of this patent is extended or adjusted under 35 U.S.C. 154(b) by 191 days.

(21) Appl. No.: 11/121,557

(22) Filed: May 4, 2005

(65) Prior Publication Data

US 2006/0266584 A1 Nov. 30, 2006

(51) Int. Cl.
*E06C 7/16* (2006.01)
*E06C 1/00* (2006.01)

(52) U.S. Cl. ..... 182/115; 182/152

(58) Field of Classification Search ..... 182/115, 182/116, 117, 118, 119, 152, 129, 230
See application file for complete search history.

(56) References Cited

U.S. PATENT DOCUMENTS 2,394,221 A * 2/1946 Waltz ..... 182/115
2,438,173 A * 3/1948 Johnson et al. ..... 182/115
2,665,950 A * 1/1954 Johnson ..... 182/115
2,720,430 A * 10/1955 Meng et al. ..... 182/115
3,093,209 A * 6/1963 Nagy ..... 182/118
3,108,657 A * 10/1963 Carlson et al. ..... 182/119
3,207,261 A * 9/1965 Petersen ..... 182/115
3,250,344 A * 5/1966 Romano ..... 182/118
3,997,024 A * 12/1976 Fredricks et al. ..... 182/119
4,026,079 A 5/1977 Morris
4,083,427 A * 4/1978 Box ..... 182/118
4,125,173 A 11/1978 Rust et al.
4,171,033 A 10/1979 Rust et al.
4,618,029 A * 10/1986 Lowry ..... 182/116
4,807,719 A * 2/1989 Burkstrand et al. ..... 182/118
5,678,653 A * 10/1997 Clinch ..... 182/119
5,988,317 A 11/1999 Riding

* cited by examiner

*Primary Examiner*—Hugh B. Thompson, II
(74) *Attorney, Agent, or Firm*—Dunlap, Codding & Rogers, P.C.

(57) ABSTRACT

A scaffold having a ladder assembly detachably connected to one end of a support frame of the scaffold, the ladder assembly being pivotally connected to one of the ends of the support frame, the ladder assembly being selectively rotatably moved between a first position and a second position; in the first position the ladder assembly is positioned adjacent one end of the frame of the scaffold and in the second position the ladder assembly is disposed substantially adjacent a side of the support platform for permitting easy access to the support platform.

6 Claims, 3 Drawing Sheets

SCAFFOLD HAVING DETACHABLE LADDER ASSEMBLY

BACKGROUND OF THE INVENTION

1. Field of the Invention

The present invention relates to a scaffold, and more particularly not by way of limitation, to a scaffold having a detachable ladder assembly.

2. Brief Description of Prior Art

Masonry and carpentry are two of many jobs that require the use of scaffolds. Scaffolds assist workers by allowing them to work at elevated positions. Conventional scaffolds ordinarily comprise a plurality of vertical posts which are connected by cross-braces and which may be stacked on top of each other to permit workmen to work walls, ceilings and the like.

One major disadvantage of the prior art scaffolds is that such scaffolds do not provide a convenient means for permitting a workman access to the support platform of the scaffold.

SUMMARY OF THE INVENTION

The present invention provides a scaffold having a detachable ladder assembly which permits a workman to have ready access to the support platform of the scaffold without causing possible injury to the workman or tipping of the scaffold as the workman climbs the scaffold to gain access to the support platform. Further, the scaffold with the detachable ladder assembly of the present invention permits the scaffold to be readily rolled along the supporting surface without interference by the ladder assembly.

DETAILED DESCRIPTION

Figure 1:
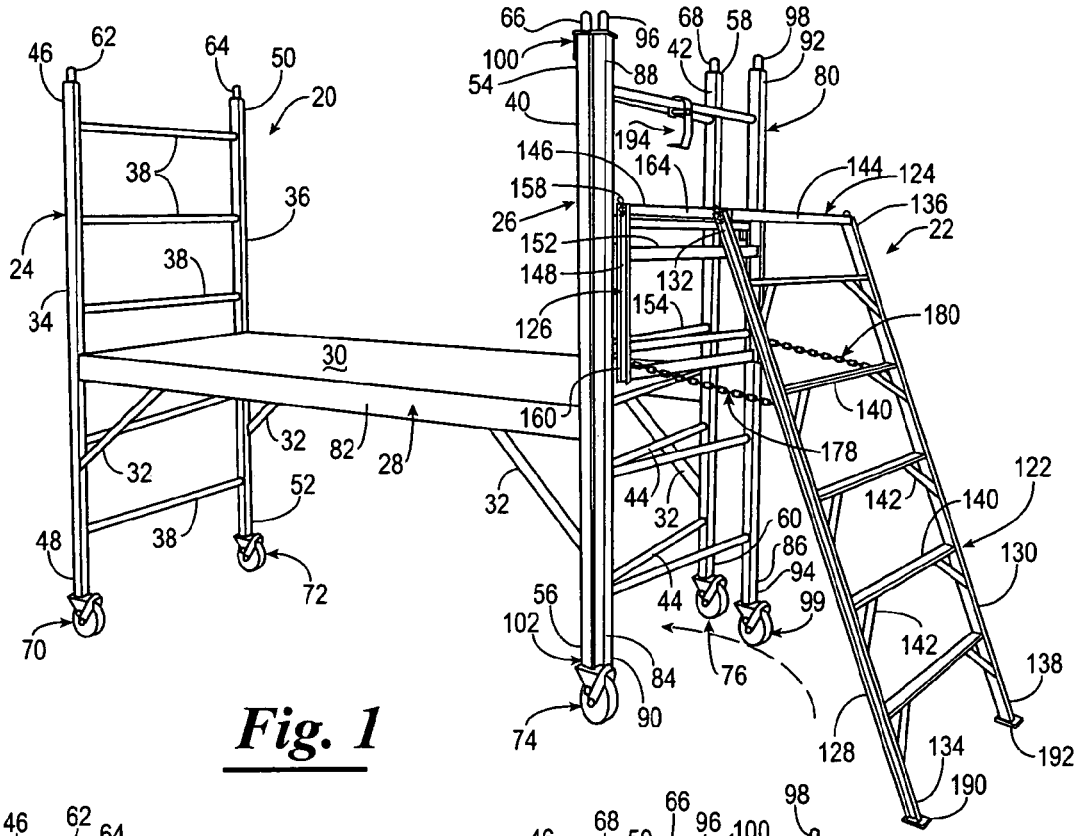
FIG. 1 is a perspective view of a scaffold having a detachable ladder assembly constructed in accordance with the present invention, the ladder assembly being disposed adjacent one end of the scaffold.
Figure 2:
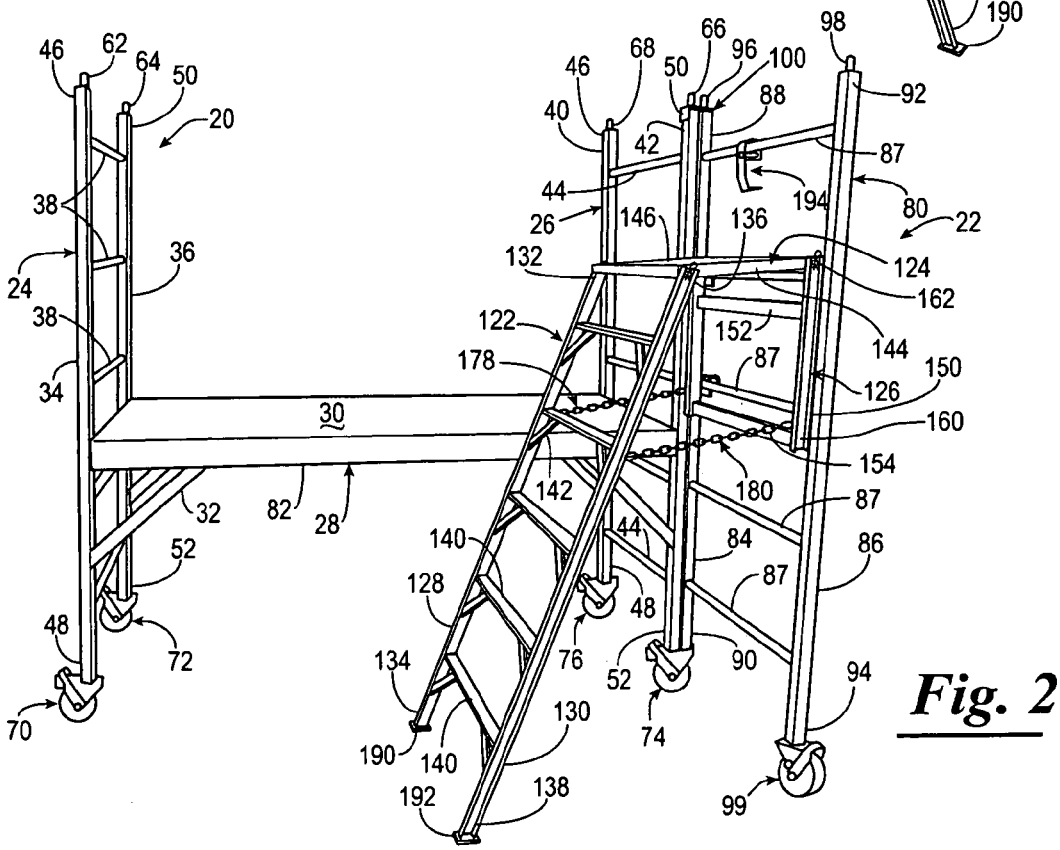
FIG. 2 is a perspective view of the scaffold having a detachable ladder assembly of FIG. 1 wherein the ladder assembly is disposed adjacent a side portion of the support platform of the scaffold.

Referring now to the drawings, and particularly to FIGS. 1 and 2, shown therein is a scaffold 20 having a ladder assembly 22 detachably connected thereto. The scaffold 20 is provided with a first end ladder 24, a spatially disposed second end ladder 26, a support frame 28, a support platform 30 supported by the support frame 28 and a plurality of angle braces 32 for connecting the support frame 28 to the first and second end ladders 24 and 26 substantially as shown. The first end ladder 24 is provided with two spatially disposed ladder legs 34 and 36, and a plurality of rungs 38 extending horizontally between the ladder legs 34 and 36. The lengths of the rungs 38 depend on the particular design of the scaffold 20. Similarly, the second end ladder 26 is provided with two spatially disposed ladder legs 40 and 42, and a plurality of rungs 44 extending horizontally between the ladder legs 40 and 42.

The ladder leg 34 of the first end ladder 24 has an upper end 46 and lower end 48, and the ladder leg 36 of the first end ladder 24 has an upper end 50 and a lower end 52. Similarly, the ladder leg 40 of the second end ladder 26 has an upper end 54 and a lower end 56, and the ladder leg 42 of the second end ladder 26 has an upper end 58 and a lower end 60.

The ladder legs 34, 36 and 40, 42 of the first and second end ladders 24 and 26, respectively, may have any suitable cross-sectional configuration. However, the preferred cross-sectional configuration of each of the ladder legs is square.

To permit the stacking of scaffolds, such as the scaffold 20, the upper end 46 of the ladder leg 34 and the upper end 50 of the ladder leg 36 of the first end ladder 24 are provided with extension pegs 62 and 64, respectively; and, the upper end 54 of the ladder leg 40 and the upper end 58 of the ladder leg 42 of the second end ladder 26 are provided with extension pegs 66 and 68, respectively.

A caster wheel assembly 70 is connected to the lower end 48 of the ladder leg 34 of the first end ladder 24, and a caster wheel assembly 72 is connected to the lower end 52 of the ladder leg 36 of the first end ladder 24. Similarly, a caster wheel assembly 74 is connected to the lower end 56 of the ladder leg 40 of the second end ladder 26, and a caster assembly 76 is connected to the lower end 60 of the ladder leg 42 of the second end ladder 26. Desirably, each of the caster wheel assemblies 70, 72, 74 and 76 includes a locking mechanism which permits the caster wheel assemblies 70, 72, 74 and 76 to be secured in a locked, non-rolling condition.

Scaffolds, such as the scaffold 20, and a caster wheel assembly, such as the caster wheel assemblies 70, 72, 74 and 76, are well known in the art. Thus, a detailed description or discussion of the scaffold 20 and caster wheel assemblies 70, 72, 74 and 76 is not believed necessary to enable one skilled in the art to fully understand the inventive concept of the scaffold 20 having the detachable ladder assembly 22 of the present invention.

In the embodiment shown in FIGS. 1 and 2, the ladder assembly 22 is detachably connected to the scaffold 20 via a third end ladder 80 such that the ladder assembly 22 can be selectively positioned adjacent one of the end ladders of the scaffold 20, such as the second end ladder 26 substantially as shown in FIG. 1; or the ladder assembly 22 can be selectively moved so that the ladder assembly 22 is disposed substantially adjacent a side 82 of the support platform 30 for permitting easy access to the support platform 30 substantially as shown in FIG. 2.

The third end ladder 80 is similar in construction to the first and second end ladders 24 and 26, respectively, except that the distance between ladder legs 84 and 86 of the third end ladder 80 is less than the distance between the ladder legs 40 and 42 of the adjacently disposed second end ladder 26 of the scaffold 20. Thus, when the third end ladder 80 is connected to the scaffold 20, the third end ladder 80 can be positioned substantially adjacent the second end ladder 26 of the scaffold 20 so as to permit movement of the scaffold 20 through doorways and the like without interference from the ladder assembly 22.

The third end ladder 80 is further provided with a plurality of rungs 87 extending horizontally between the two spatially disposed ladder legs 84 and 86. The ladder leg 84 of the third end ladder 80 has an upper end 88 and a lower end 90, and the ladder leg 86 of the third end ladder 80 has an upper end 92 and a lower end 94. The upper end 88 of the ladder leg 84 of the third end ladder 80 is provided with an extension peg 96. If desired, the upper end 92 of the ladder leg 86 of the third end ladder 80 can also be provided with an extension peg, such as extension peg 98.

To assist in the movement of the third end ladder 80, and thus the ladder assembly 20 between the positions shown in FIG. 1 and FIG. 2, when the third end ladder 80 is connected to the second end ladder 26 of the scaffold 20 as will be discussed in more detail hereinafter, a caster wheel assembly 99 is connected to the lower end 94 of the ladder leg 86 of the third end ladder 80. The caster wheel assembly 99 is similar in construction to the caster wheel assemblies 70, 72, 74 and 76. Thus, the caster wheel assembly 99 desirably includes a locking mechanism which permits the caster wheel assembly 99 to be secured in a locked, non-rolling condition.

As previously stated, the distance between the ladder legs 84 and 86 of the third end ladder 80 is less than the distance between the ladder legs 40 and 42 of the second end ladder 26. Thus, the caster wheel assembly 99 can be disposed inwardly from the caster wheel assembly 76 of the second end ladder 26 when the third end ladder 80 is disposed substantially adjacent the second end ladder 26 of the scaffold 20.

To connect the third end ladder 80 to the second end ladder 26 of the scaffold 20, a first connector assembly 100 (FIG. 4B) is disposed on the extension peg 66 of the ladder leg 40 of the second end ladder 26 and on the extension peg 96 of the ladder leg 84 of the third end ladder 80. A second connector assembly 102 (FIG. 4C) connects the caster wheel assembly 74 to the lower end 56 of the ladder leg 40 of the second end ladder 26 and to the lower end 90 of the ladder leg 84 and the third end ladder 80. The pivotal connection of the ladder leg 84 of the third end ladder 80 to the ladder leg 40 of the second end ladder 26 via the first and second connector assemblies 100 and 102, enables the third end ladder 80 to be selectively moved between the position shown in FIG. 1 and the position shown in FIG. 2.

Figure 4A:
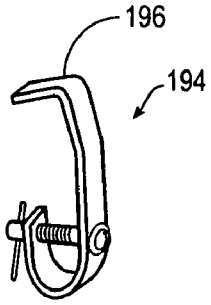
FIG. 4A is a perspective view of a hook connectable to an end ladder of the scaffold for securing the detachable ladder assembly in a raised position for movement of the scaffold along a supporting surface.
Figure 4B:
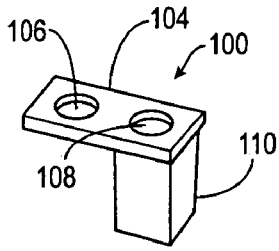
FIG. 4B is a perspective view of a connector assembly of the scaffold having a detachable ladder assembly of the present invention for permitting selective movement of the ladder assembly from a position substantially adjacent an end ladder of the scaffold as shown in FIG. 1 to a position wherein the ladder assembly is disposed adjacent the support platform of the scaffold as shown in FIG. 2.

As more clearly shown in FIG. 4B, the first connector assembly 100 includes a plate 104 having a pair of spatially disposed openings 106 and 108 formed therein and a substantially L-shaped housing 110 disposed about the opening 108. The L-shaped housing 110 is provided with a configuration similar to that of substantially L-shaped housing 112 of the second connector assembly 102 shown in FIG. 4C. The openings 106 and 108 are spaced a sufficient difference apart and sized so that extension peg 66 on the upper end 54 of the ladder leg 40 of the second end ladder can be disposed through the opening 108 in the plate 104, and the extension peg 96 formed on the upper end 88 of the ladder leg 84 of the third end ladder 80 can be disposed through the opening 106 formed in the plate 104. The substantially L-shaped housing 110 of the first connector assembly 100 stabilizes the first connector assembly 100 on the upper end 54 of the ladder leg 46 of the second end ladder 26.

Figure 4C:
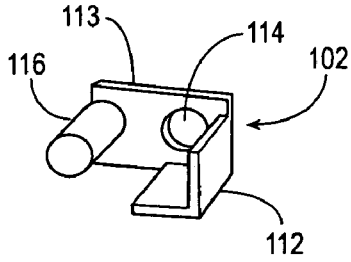
FIG. 4C is a perspective view of another connector assembly of the scaffold having a detachable ladder assembly of the present invention for permitting selective movement of the ladder assembly from a position substantially adjacent an end ladder of the scaffold as shown in FIG. 1 to a position wherein the ladder assembly is disposed adjacent the support platform of the scaffold as shown in FIG. 2.

Referring now to FIG. 4C, in combination with FIGS. 1 and 2, the second connector assembly 102, which connects the lower end 90 of the ladder leg 84 of the third end ladder 80 to the caster wheel assembly 74 and to the lower end 56 of the ladder leg 40 of the second end ladder 26, cooperates with the first connector assembly 100 for permitting movement of the third end ladder 80, and thus the ladder assembly 22, relative to the second end ladder 26 of the scaffold 20. The second connector assembly 102 is provided with a plate 113 having an opening 114 and an extension peg 116 disposed on an end portion of the plate 113 such that the extension peg 116 is aligned with and spatially disposed from the opening 114 in the plate 113. The connector assembly 102 is further provided with the substantially L-shaped housing member 112 disposed about a portion of the opening 114 for stabilizing the second connector assembly 102 on the bottom end 56 of the ladder leg 40 of the second end ladder 26 when a spindle (not shown) of the caster wheel assembly 74 is disposed through the opening 114 in the plate 113 and into the lower end 56 of the ladder leg 40 of the second end ladder 26. The extension peg 116 of the second connector assembly 102 is sized and configured so that the extension peg 116 of the second connector assembly 102 is disposed in the ladder leg 84 of the third end ladder 80 via the lower end 90 thereof. Thus, the second connector assembly 102 is disposed between the caster wheel assembly 74 at the lower end 56 of the ladder leg 40 of the second end ladder 26 and the lower end 90 of the ladder leg 84 of the third end ladder 80.

Figure 3:
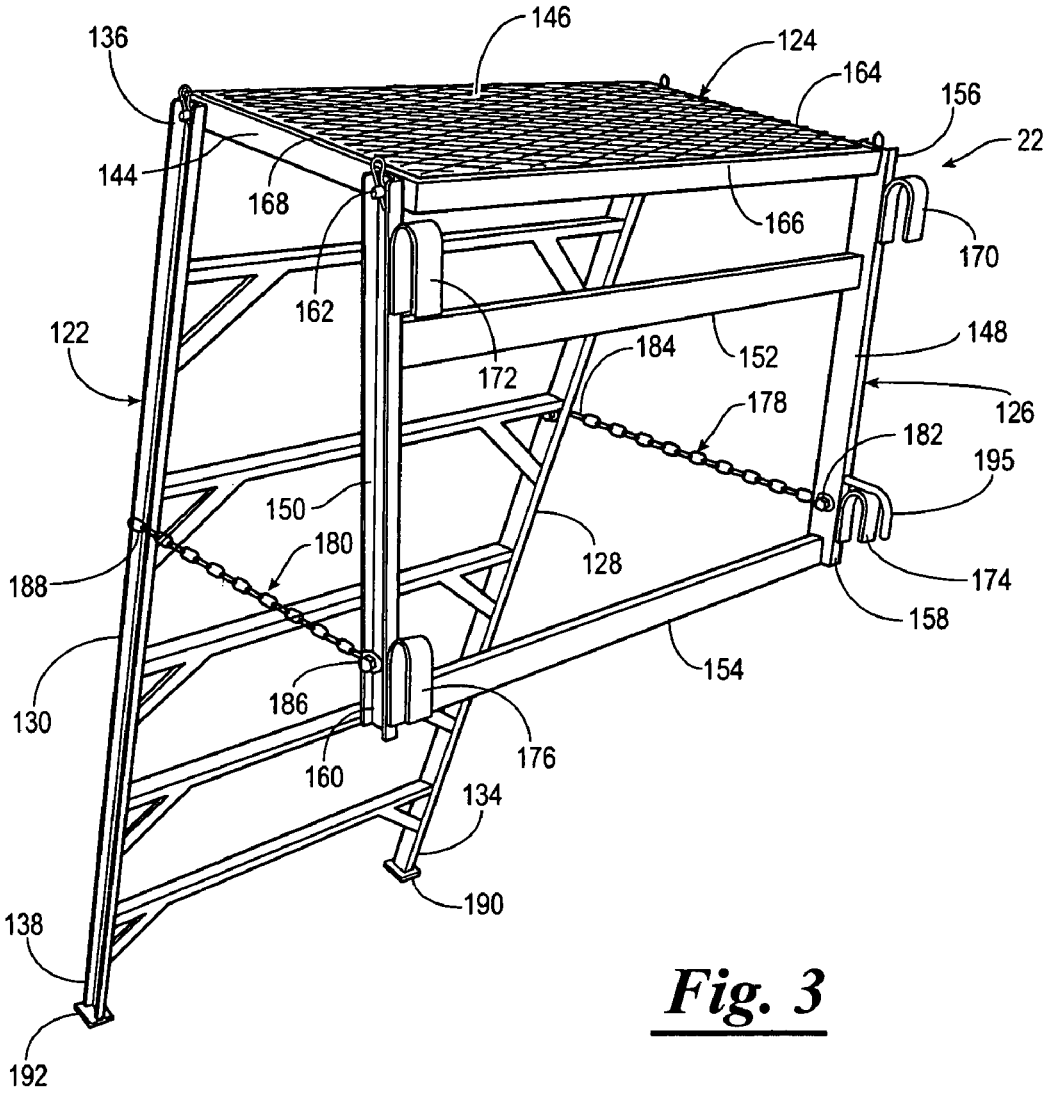
FIG. 3 is a perspective view of the detachable ladder assembly of FIGS. 1 and 2.

Referring now to FIGS. 1–3, the ladder assembly 22, which is connected to the second end ladder 26 of the scaffold 20 includes, in addition to the third end ladder 80, a step assembly 122, a platform 124 and a ladder connector assembly 126. As will be described in more detail hereinafter, the step assembly 122 is pivotally connected to the platform 124, and the platform 124 is pivotally connected to the ladder connector assembly 126 so that the step assembly 122 can be selectively moved and secured in a raised position when the ladder assembly 22 is disposed substantially adjacent the second end ladder 26 of the scaffold 20 and the scaffold 20 having the ladder assembly 22 connected thereto is moved from one location to another. Any suitable mechanism can be employed for pivotally connecting the step assembly 122 to the platform 124 at the platform 124 to the ladder connector assembly 126.

The step assembly 122 includes a first leg member 128 and a spatially disposed second leg member 130. The first leg member 128 is provided with an upper end 132 and a lower end 134 and the second leg member 130 provided with an upper end 136 and a lower end 138. A plurality of horizontally disposed rungs 140 extend between the first and second leg member 128 and 130 so that a person can travel up and down the step assembly 122 when the ladder assembly 22 is connected to the third end ladder 80, and the third end ladder 80 is connected to the second end ladder 26 of the scaffold 20. To stabilize the horizontally disposed rungs 140, as well as to provide strength to the rungs 140, a plurality of stabilizing members 142 are disposed between each of the rungs 140 and the adjacently disposed first and second leg members 128 and 130 of the step assembly 122 substantially as shown.

The platform 124 includes a frame 144 and a support member 146 connected to the frame 144. The frame member 144, which is disposed about and under a portion of the support member 146, is pivotally connected to the first and second leg member 128 and 130 of the step assembly 122 via their respective upper ends 132 and 136, and the frame member 144 is also pivotally connected to the ladder connector assembly 126.

The ladder connector assembly 126 includes substantially vertically, disposed leg members 148 and 150 and a plurality of substantially horizontal, spatially disposed cross-braces 152 and 154. The substantially vertically disposed leg member 148 has a first end 156 and a second end 158, and the substantially vertical disposed leg member 150 has a first end 160 and a second end 162. The first end 156 of the substantially vertically disposed leg member 148 is pivotally connected to one side 164 of the frame 144 of the platform 124 substantially adjacent one end 166 of the platform 124, and the first end 160 of the substantially vertically disposed leg member 150 is pivotally connected to an opposite side 168 of the frame 144 substantially adjacent the end 166 of the frame 134 substantially as shown in FIGS. 1–3. The substantially vertically disposed leg members 148 and 150 of the ladder connector assembly 126 are connected to the frame 144 of the platform 124 such that the vertically disposed leg member 148 is spatially disposed from and aligned with the first leg member 128 of the step assembly 122 and the substantially vertically disposed leg member 150 is spatially disposed from and aligned with the second leg member 130 on the step assembly 122.

The cross-brace 152 is disposed between and connected to the substantially vertically disposed leg members 148 and 150 of the ladder connector assembly 126, a distance from the first ends 156 and 160 of the substantially vertically disposed leg member 148 and 150, respectively, and the cross-brace 154 extends between and is connected to the second ends 158 and 162 of the vertically disposed leg member 148 and 150, respectively.

The ladder connector assembly 126 further includes a plurality of hook members 170, 172, 174 and 176 secured to the substantially vertically disposed leg member 148 and 150. The hook members 170 and 174 are spatially disposed on the substantially vertically disposed leg member 148 and the hook members 172 and 176 are spatially disposed on the substantially vertically disposed leg member 150 such that the hook member 170 is aligned with the hook member 172 and the hook member 174 is aligned with the hook member 176 substantially as shown. The distance between the hook members 170 and 174 on the substantially vertically disposed leg member 148, and thus the distance between the hook members 172 and 176 on the substantially vertically disposed leg member 150, enable the ladder connector assembly 126 to be connected to and supported by two of the rungs 87 of the third end ladder 80.

To maintain the first and second leg members 128 and 130 of the step assembly 122 in an extended position relative to the connector assembly 126, the ladder assembly 22 also includes a plurality of chains 178 and 180. One end 182 of the chain 178 is connected to the substantially vertically disposed leg member 148 of the ladder connector assembly 126 and an opposed second end 184 or the chain 178 is connected to the first leg member 128 of the step assembly 122 of the ladder assembly 22. Similarly, the chain 180 is connected at one end 186 to the substantially vertically disposed leg member 150 of the ladder connector assembly 126 and an opposed second end 188 of the chain 180 is connected to the second leg member 130 of the step assembly 122 of the ladder assembly 22. Thus, when the step assembly 122 of the ladder assembly 22 is moved to an extended position as shown in FIGS. 1 and 2, the chains 178 and 180 prevent further outward movement of the first and second leg member 128 and 130 of the step assembly 122 when weight is positioned thereon.

To stabilize the step assembly 122 of the ladder assembly 22 in the extended position, the ladder assembly 22 further includes a foot or shoe 190 connected to the lower end 134 of the first leg member 128 of the step assembly 122 and a foot or shoe 192 connected to the lower end 138 of the second leg member 130 of the step assembly 122. The shoes 190 and 192 are each provided with a substantially planar lower surface so that when the step assembly 122 is in the extended operative position and the shoes 190 and 192 engage a supporting surface, the shoes 190 and 192 provide stability to the step assembly 122 of the ladder assembly 22.

The ladder assembly 22 further includes a connector member 194 (FIGS. 1, 2, and 4A) and a stop member 195 (FIG. 3). The connector member 194 is connected to one of the rungs 87 of the third end ladder 80 so that the ladder assembly 22 can be secured in a raised position for movement of the ladder assembly 22 between various positions relative to the scaffold 20. That is, a distal end 196 of the connector member 194 is provided with a hook configuration which is adapted to engage the side 166 of the frame 144 of the platform 124 of the ladder assembly 22 when the platform 124, and thus the first and second leg members 128 and 130 of the step assembly 122, are moved to a raised position for securing the platform 124 and the step assembly 122 in a raised position so that the shoes 190 and 192 of the ladder assembly 22 do not engage the supporting surface.

The stop member 195 is connected to the first leg member 128 of the ladder connector assembly 126 substantially adjacent the hook member 176 of the ladder connector assembly 126. The stop member 195 is configured to abuttingly engage the rung 44 of the end ladder 26 supporting the ladder assembly 22 via the hook members 174 and 176 of the ladder connector assembly 126. The stop member 195 can be of any configuration as long as the stop member 195 is adapted to engage the rung 44 of the second end ladder 26 when the hook members 174 and 176 are disposed substantially adjacent the second end ladder 26 of the scaffold 20 as shown in FIG. 1.

Figure 5:
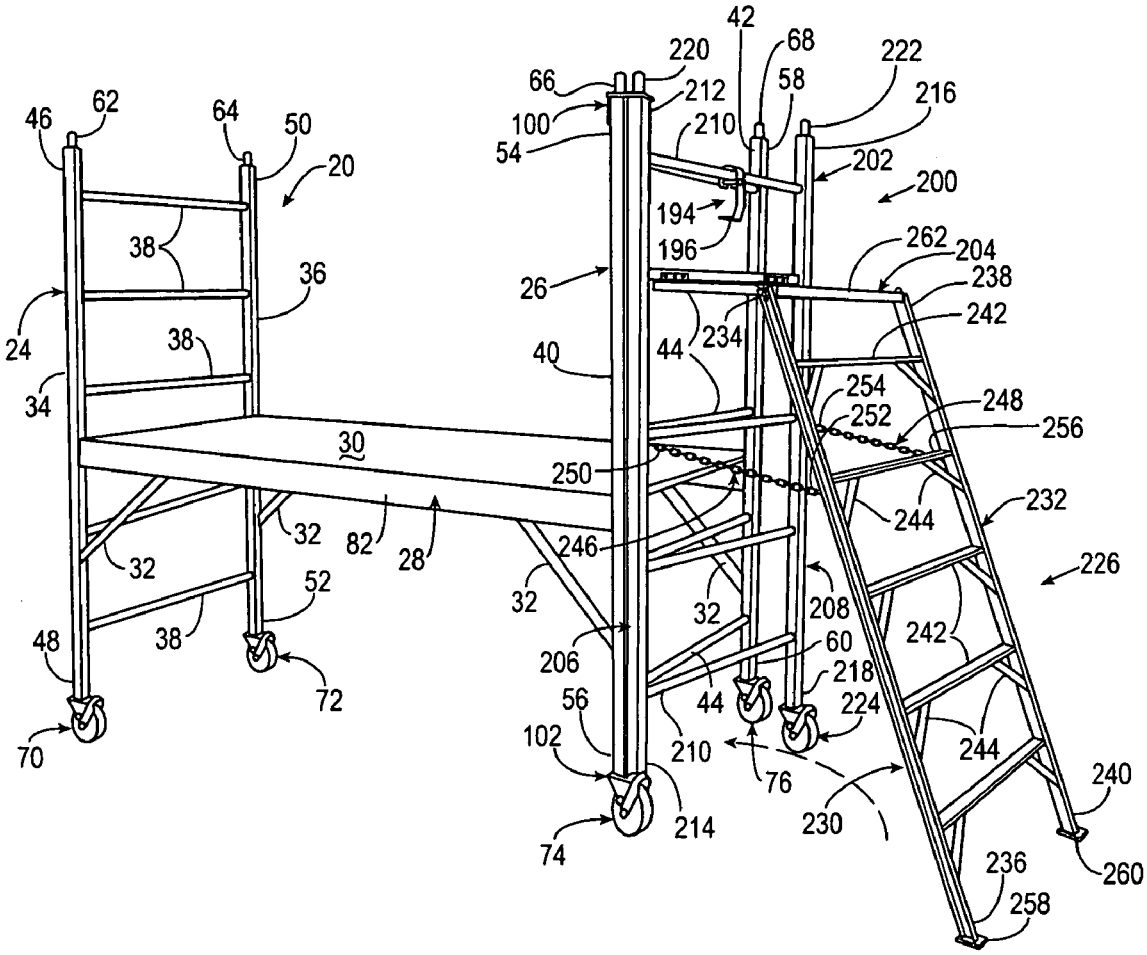
FIG. 5 is a perspective view of a scaffold having another embodiment of a detachable ladder assembly constructed in accordance with the present invention connected thereto.

Referring now to FIG. 5, another embodiment of a ladder assembly 200 is shown. The ladder assembly 200 is connected to the second end ladder 26 of the scaffold 20 via the first and second connector assemblies 100 and 102, as herein before described with reference to FIGS. 1, 2, 4B and 4C. The ladder assembly 200 includes an end ladder 202 which is similar in construction to the end ladder 80 herein before described with reference to the ladder assembly 22 except the end ladder 202 is pivotally connected to a platform 204 of the ladder assembly 200, and the end ladder 202 desirably has a width substantially corresponding to the width of the platform 204 which is less than the width of the end ladder 202 is less than the width of the second end ladder 26 of the scaffold 20 to which the end ladder 202 of the ladder assembly 200 is connected.

The end ladder 202 includes spatially disposed ladder legs 206 and 208 and a plurality of rungs 210 extending horizontally between the ladder legs 206 and 208 as shown. The ladder leg 206 of the end ladder 202 has an upper end 212 and a lower end 214, and the ladder leg 208 of the end ladder 202 has an upper end 216 and a lower end 218. The upper end 202 of the ladder leg 206 of the end ladder 202 of the ladder assembly 200 is provided with an extension peg 220.

If desired, the upper end 216 of the ladder leg 208 of the end ladder 80 of the ladder assembly 200, can also be provided with an extension peg, such as extension peg 222.

To assist in the movement of the ladder assembly 200 between positions similar to those shown in FIG. 1 and FIG. 2 when the ladder assembly 200 is connected to the second end ladder 26 of the scaffold 20 as will be discussed in more detail hereinafter, a castor wheel assembly 224 is connected to the lower end 218 of the ladder leg 208 of the end ladder 202. The caster wheel assembly 224 is similar in construction to the caster wheel assemblies 70, 72, 74 and 76 of the scaffold 20. Thus, the caster wheel assembly 224 desirably includes a locking mechanism which permits the caster wheel assembly 224 to be secured in a locked, non-rolling condition.

As previously stated, the distance between the ladder legs 206 and 208 of the third end ladder 202 is less than the distance between the ladder legs 40 and 42 of the second end ladder 26. Thus, the wheel caster assembly 224 can be disposed inwardly from the wheel caster assembly 76 of the second end ladder 26 when the third end ladder 202 is disposed substantially adjacent the second end ladder 26 of the scaffold 20.

To connect the ladder assembly 200 to the second end ladder 26 of the scaffold 20, the first connector assembly 100 (FIG. 4B) is disposed on the extension peg 66 of the ladder leg 40 of the second end ladder 26 and on the extension peg 220 of the ladder leg 206 of the end ladder 202. The second connector assembly 102 (FIG. 4C) connects the caster wheel assembly 74 to the lower end 214 of the ladder leg 206 of the end ladder 202 and to the lower end 56 of the ladder leg 40 of the second end ladder 26 in the same manner as herein before described with reference to the connection of the third end ladder 80 to the second end ladder 26. Thus, the pivotal connection of the ladder leg 206 of the end ladder 202 of the ladder assembly 200 to the ladder leg 40 of the second end ladder 26 via the first and second connector assemblies 100 and 102 enables the ladder assembly 200 to be selectively moved between positions similar to those shown in FIG. 1 and FIG. 2.

As previously described with reference to FIG. 4B, the openings 106 and 108 in the plate 104 of the first connector assembly 100 are spaced a sufficient difference apart and sized so that the extension peg 66 on the upper end 54 of the ladder leg 40 of the second end ladder 26 can be disposed through the opening 108 in the plate 104, and the extension peg 220 formed on the upper end 212 of the ladder leg 206 of the end ladder 202 of the ladder assembly 200 can be disposed through the opening 106 formed in the plate 104. The substantially L-shaped housing 110 of the first connector assembly 100 stabilizes the first connector assembly 100 on the upper end 54 of the ladder leg 46 of the second end ladder 26.

As previously described with reference to FIG. 4C, the second connector assembly 102, which connects the lower end 214 of the ladder leg 206 of the end ladder 202 of the ladder assembly 200 and the lower end 56 of the ladder leg 40 of the second end ladder 26 to the caster wheel assembly 74, and which cooperates with the first connector assembly 100 for permitting movement of the ladder assembly 200 relative to the second end ladder 26 of the scaffold 20, includes the plate 113 having the opening 114 and the extension peg 116 disposed on the end portion of the plate 113 such that the extension peg 116 is aligned with and spatially disposed from the opening 114 in the plate 113. The connector assembly 102 is further provided with the substantially L-shaped housing member 112 disposed about a portion of the opening 114 for stabilizing the second connector assembly 102 on the bottom end 56 of the ladder leg 40 of the second end ladder 26 when a spindle (not shown) of the caster wheel assembly 74 is disposed through the opening 114 in the plate 113 and into the lower end 56 of the ladder leg 40 of the second end ladder 26. The extension peg 116 of the second connector assembly 102 is disposed into the ladder leg 206 of the end ladder 202 of the ladder assembly 20 via the lower end 90 thereof. Thus, the second connector assembly 102 connects the caster wheel assembly 74 to the lower end 56 of the ladder leg 40 of the second end ladder 26 and the lower end 214 of the ladder leg 206 of the third end ladder 202.

The ladder assembly 200 further includes a step assembly 226 and the platform 204. The step assembly 226 is pivotally connected to the platform 204, and the platform 204 is pivotally connected to the end ladder 202 so that the step assembly 226 can be selectively moved and secured in a raised position when the ladder assembly 200 is disposed substantially adjacent the second end ladder 26 of the scaffold 20 and the scaffold 20 having the ladder assembly 200 connected thereto is moved from one location to another. Any suitable mechanism can be employed to pivotally connect the step assembly 226 to the platform 204 and the platform 204 to the end ladder 202.

The step assembly 226 includes a first leg member 230 and a spatially disposed second leg member 232. The first leg member 230 is provided with an upper end 234 and a lower end 236, and the second leg member 232 provided with an upper end 238 and a lower end 240. A plurality of horizontally disposed rungs 242 extend between the first and second leg member 230 and 232 so that a person can travel up and down the step assembly 226 when the ladder assembly 200 is connected to the second end ladder 26 of the scaffold 20. To stabilize the horizontally disposed rungs 242, as well as to provide strength to the rungs 242, a plurality of stabilizing members 244 are disposed between each of the rungs 242 and the adjacently disposed first and second leg members 230 and 232 of the ladder assembly 200 substantially as shown.

The platform 204 is pivotally connected to the first and second leg member 230 and 232 via their respective upper ends 234 and 238, and to the ladder legs 206 and 208 of the end ladder 202 of the ladder assembly 200.

To maintain the first and second leg members 230 and 232 of the step assembly 226 in an extended position relative to the end ladder 202, the ladder assembly 200 also includes a plurality of chains 246 and 248. One end 250 of the chain 246 is connected to the ladder leg 206 of the end ladder 202, and an opposed second end 252 or the chain 246 is connected to the first leg member 230 of the step assembly 226 of the ladder assembly 200. Similarly, the chain 248 is connected at one end 254 to the ladder leg 208 and an opposed second end 256 of the chain 248 is connected to the second leg member 232 of the step assembly 226 of the ladder assembly 200. Thus, when the step assembly 226 of the ladder assembly 200 is moved to an extended position as shown in FIG. 5, the chains 246 and 248 prevent further outward movement of the first and second leg member 230 and 232 of the step assembly 226 when weight is positioned thereon.

To stabilize the step assembly 226 of the ladder assembly 200 in the extended position, the ladder assembly 200 further includes a foot or shoe 258 connected to the lower end 236 of the first leg member 230 of the step assembly 226 and a foot or shoe 260 connected to the lower end 240 of the second leg member 232 of the step assembly 226. The shoes

258 and 260 are each provided with a substantially planar lower surface so that when the step assembly 226 is in the extended operative position and the shoes 258 and 260 engage a supporting surface, the shoes 258 and 260 provide stability to the step assembly 226 of the ladder assembly 200.

The ladder assembly 200 further includes the connector member 194 shown in FIG. 4A and hereinbefore described. The connector member 194 is connected to one of the rungs 210 of the end ladder 202, such as the top rung 210 so that when the platform 204 is pivotally moved in an upward direction and connected to the connector member 194, the step assembly 226 is also moved to a raised position so that the shoes 258 and 260 do not engage the supporting surface. That is, the distal end 196 of the connector member 194 is provided with a hook configuration which is adapted to engage a side 262 of the platform 204 of the ladder assembly 200 when the platform 204, and thus the first and second leg members 230 and 232 of the step assembly 226 are moved to a raised position for securing the platform 204 and the step assembly 226 in a raised position so that the shoes 258 and 260 of the ladder assembly 200 do not engage the supporting surface.

It can readily be appreciated that the unique construction and design of the ladder assemblies 22 and 200, as well as their connection to the scaffold 20, facilitates access to the support platform of the scaffold by a workman while eliminating the possibility of the scaffold tipping as the workman climbs either off the ladder assemblies 22 and 200 when same are attached to the scaffold 20. Further, the construction and design of the ladder assemblies 22 and 220, together with the design of the first and second connector assemblies 100 and 102 and thus the connection of the ladder assemblies 22 and 200, to the scaffold 20 permit the scaffold 20 to be readily rolled along a supporting surface.

What is claimed is:

1. A scaffold, comprising:

a support frame having a first end and a second end;

a support platform positioned between the first and second ends of the support frame, the support platform supported by the support frame; and a ladder assembly detachably connected to one end of the support frame, the ladder assembly including a ladder having a pair of spatially disposed leg members, the leg members having at least one rung extending therebetween, the ladder assembly pivotally connected to one of the ends of the support frame such that the ladder assembly is selectively rotatable between a first position and a second position, in the first position the ladder assembly being positioned adjacent one end of the support frame of the scaffold and in the second position the ladder assembly being disposed substantially adjacent a side of the support platform for permitting easy access to the support platform.

2. The scaffold of claim 1 wherein the ladder assembly comprises:

a ladder connector assembly having a connector member connected to the at least one rung of the extending between the spatially disposed leg members of the ladder assembly so that the ladder assembly can be secured in a raised position for movement of the ladder assembly between various positions relative to the scaffold;

a platform being pivotally connected to the ladder connector assembly, the platform having a frame and a support member connected to the frame, and a step assembly being pivotally connected to the platform, the step assembly having a first leg member and a spatially disposed second leg member wherein at least one horizontally disposed rung extends therebetween.

3. The scaffold of claim 2 wherein the ladder connector assembly of the ladder assembly is provided with a plurality of spatially disposed hook members for connecting the ladder assembly to the at least one rung extending between the pair of spatially disposed leg members of the ladder assembly.

4. The scaffold of claim 2 wherein at least one lower end of the first and second leg members of the step assembly of the ladder assembly is provided with a shoe for stabilizing the step assembly of the ladder assembly.

5. The scaffold of claim 2 wherein the ladder assembly is further provided with a stop member connected to the connector member of the ladder connector assembly, the stop member is configured to engage at least one end of the ladder assembly.

6. The scaffold of claim 2 wherein the ladder assembly being provided with a connector pivotally connectable to one of the rungs extending between the spatially disposed leg members of the ladder assembly such that as the platform of the ladder assembly is pivotally moved in an upward direction and connected to the connector, the step assembly is moved to a raised position to disengage a supporting surface.

* * * * *